United States Patent [19]

Paolucci

[11] Patent Number: 4,910,822

[45] Date of Patent: Mar. 27, 1990

[54] SYSTEM FOR DRYING OF A WATER DISPERSION GLUE ON SHOE UPPERS AND/OR SOLES

[75] Inventor: Enzo Paolucci, Macerata, Italy

[73] Assignee: Unimac Italia S.r.l., Ascoli Piceno, Italy

[21] Appl. No.: 254,576

[22] Filed: Oct. 7, 1988

[30] Foreign Application Priority Data

Oct. 8, 1987 [IT] Italy ..... 41699 A/87

[51] Int. Cl.[4] ..... A43D 89/00

[52] U.S. Cl. ..... 12/33.2; 12/142 RS; 34/15; 34/92

[58] Field of Search ..... 12/33.2, 142 RS, 142 T, 12/1 A; 427/350; 264/344; 34/15, 92

[56] References Cited

U.S. PATENT DOCUMENTS 2,549,981 4/1951 Maeser et al. ..... 12/33.2 X
3,773,054 11/1973 Clark ..... 34/92 X
4,703,533 11/1987 Barma ..... 12/142 E

*Primary Examiner*—Henry A. Bennet
*Assistant Examiner*—John Sollecitg
*Attorney, Agent, or Firm*—Charles E. Brown; Charles A. Brown

[57] ABSTRACT

The device is intended to dry the glue (containing polyurethane, neoprene, natural or synthetic rubber or mixtures thereof) after it has been spread on shoe uppers and/or soles. The device can be included in a system which includes carding, spreading and reactivation of the parts in order to press them together. The device comprises one or more vacuum chambers into which the shoe uppers and soles to which a water dispersion glue has previously been applied are fed, the vacuum chamber being subject to heat and decreased pressure under conditions to produce rapid evaporation of water and drying of the glue. The temperature can be fixed beforehand and increased by a source of heat.

3 Claims, 2 Drawing Sheets

SYSTEM FOR DRYING OF A WATER DISPERSION GLUE ON SHOE UPPERS AND/OR SOLES

BACKGROUND OF INVENTION (1) Field of the Invention

This invention relates to a method and a device for drying a water dispersion glue on shoe uppers and/or soles.

(2) Description of Prior Art

To the present day the glue used in the manufacture of shoes, both for uppers and soles, has been spread by hand and normally, solvent solution glues of various characteristics have been used.

There are some machines which are ideal for spreading both glues with a solvent base as well as those being in water dispersion (hereinafter referred to as water dispersion glue). So far, a system does not exist, which functions, for the spreading and drying of both polyurethane and neoprene based glues manufactured in water dispersion. The system according to the invention consists of a modular working area that can meet the requirements of both small and large shoe industries. The area consists of one or more chambers inside which a pressure lower than atmospheric is created in order to obtain controlled drying, in a very short time, of the supports on which the glue has been spread beforehand. Obviously, the dimensions of the chambers (hereinafter referred to as vacuum chambers) can be increased and therefore the chambers may contain more soles or uppers, or a various quantity of both).

SUMMARY OF INVENTION

The invention relates to an apparatus wherein shoe uppers and soles are provided with an adhesive and are thereafter assembled together to result in shoes. A device provided which comprises means for applying an adhesive consisting essentially of a water dispersion glue to the shoe uppers and soles, at least one vacuum chamber and means for feeding the shoe uppers and soles having the water dispersion glue applied thereto to the vacuum chamber, and means for applying heat and reducing pressure to lower than atmospheric in the vacuum chamber under conditions enabling to dry the applied water dispersion glue. The fall in pressure produces a more rapid evaporation of the water, and when applied for a predetermined length of time the drying phase can be part of a more complex cycle of continuous production of shoe manufacture. A source of heat can be provided in the vacuum chamber which helps to optimize the work in terms of drying velocity. This invention constitutes an important technical progress as, with this system, water dispersion glues can be used, with industrial methods, thus eliminating the use of toxic and polluting glues which are dangerous for the workers and which are difficult to remove.

Figure 1:
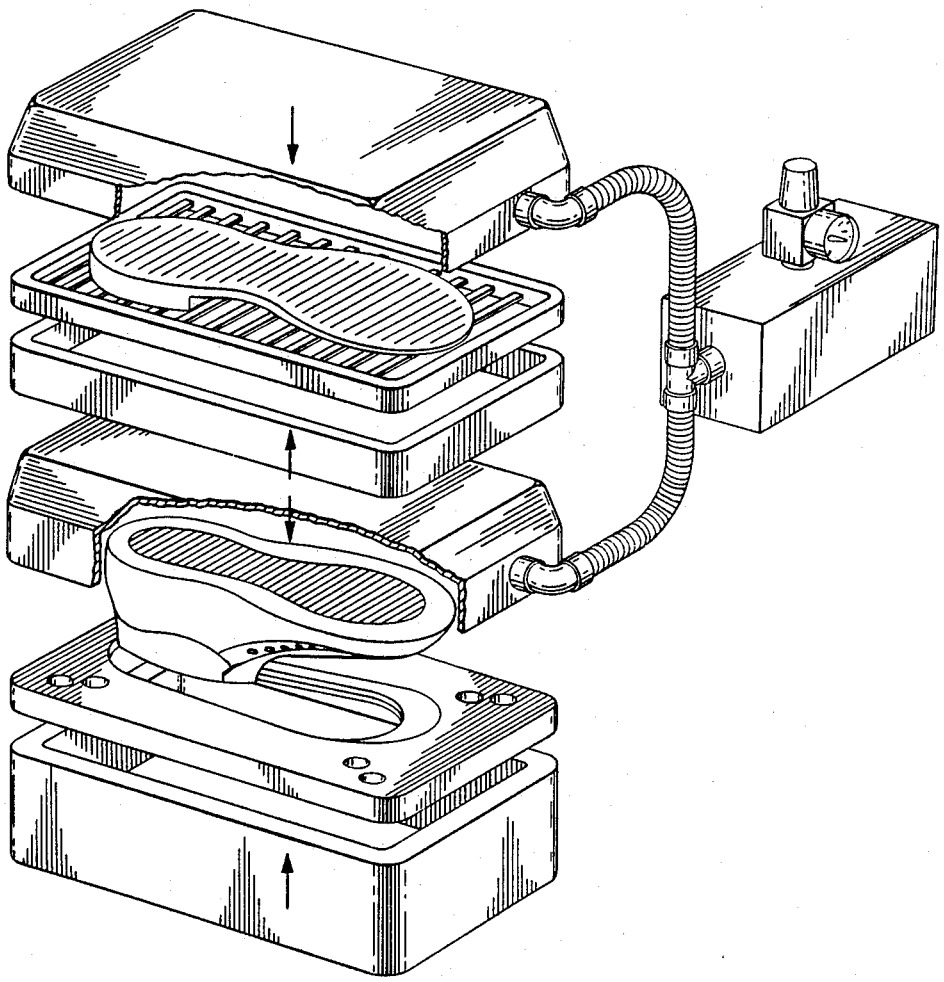
FIG. 1 shows two vacuum chambers, one for shoe uppers and one for soles.
Figure 2:
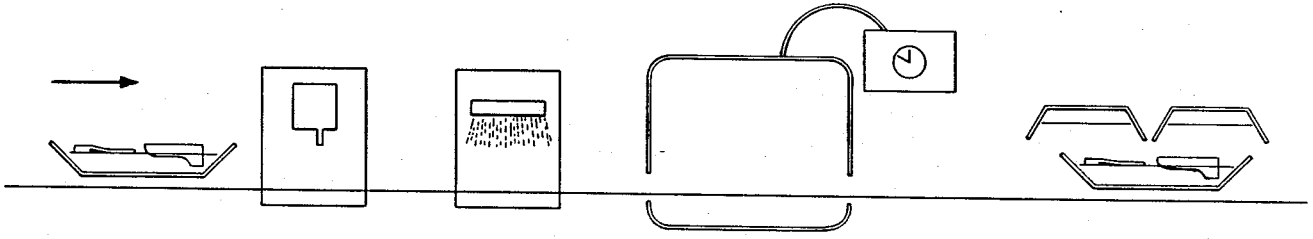
FIG. 2 is a diagram illustrating an embodiment of the invention.

A machine according to the invention will be made up of a rotating table not shown on which both the uppers and the soles are positioned, immediately after the uppers have been assembled on the latter. Some workers will be placed around the main rotating table who will carry out the main phases. Controlled by a single computer; the following are the various phases in their most complete version:

(a) carding of the uppers by means of steel brushes or a milling cutting machine, according to the requirements and the materials used:

(b) application of the glue with a spreading system: two or more pairs of soles and uppers are prepared at the same time:

(c) drying which is carried out in vacuum chambers inside of which a source of heat will be provided and which will bring the heat inside the chamber to about 50 degrees in a few seconds. After this, pressure is reduced. This is all carried out in very little time—about two mins.:

(d) reactivation by means of halogen quartz lamps, with temperatures which can be regulated by a timer.

These are schematic ways which are sufficient for the skilled person to make the invention function. Consequently when actually applied, there might be some variations which however, are not detrimental to the essential part of this invention.

I claim:

1. In an apparatus wherein shoe uppers and soles are provided with an adhesive and are thereafter assembled together to result in shoes, a device which comprises means for applying an adhesive consisting essentially of a water dispersion glue to said shoe uppers and soles, at least one vacuum chamber and means for feeding said shoe uppers and soles having said water dispersion glue applied thereto to said vacuum chamber, and means for applying heat and reducing pressure to lower than atmospheric in said vacuum chamber under conditions enabling to dry said applied water dispersion glue.

2. In an apparatus according to claim 1, which comprises a halogen lamp provided in said vacuum chamber to apply heat to said shoe uppers and soles.

3. In an apparatus according to claim 2, which comprises a plurality of said vacuum chambers.

* * * * *